US005660074A

United States Patent [19]

Kaji

[11] Patent Number: 5,660,074

[45] Date of Patent: Aug. 26, 1997

[54] METHOD OF SELECTING A PRELOAD OIL PRESSURE VALVE FOR A DIE CUSHION PIN PRESSURE EQUALIZING SYSTEM OF A PRESS MACHINE

[75] Inventor: Nobuyuki Kaji, Ishikawa, Japan

[73] Assignees: Toyota Jidosha Kabushiki Kaisha; Kabushiki Kaisha Komatsu Kaisha, both of Japan

[21] Appl. No.: 572,503

[22] Filed: Dec. 14, 1995

Related U.S. Application Data

[63] Continuation of Ser. No. 167,865, filed as PCT/JP92/00775, Jun. 17, 1992, published as WO92/22391, Dec. 23, 1992, abandoned.

[30] Foreign Application Priority Data

Jun. 17, 1991 [JP] Japan ..... 3-144924

[51] Int. Cl.[6] ..... B21D 24/02

[52] U.S. Cl. ..... 72/350; 72/453.13

[58] Field of Search ..... 72/19.9, 350, 351, 72/453.13; 267/119

[56] References Cited

U.S. PATENT DOCUMENTS 4,745,792 5/1988 Story et al. .

5,241,849 9/1993 Baur .

5,255,552 10/1993 Biefeldt .

5,299,444 4/1994 Kirii et al. ..... 72/351

FOREIGN PATENT DOCUMENTS

053140A1 9/1992 European Pat. Off. .

4128973 8/1991 Germany .

62-20711 2/1987 Japan .

62-46125 3/1987 Japan .

1-60721 4/1989 Japan .

2-108597 8/1990 Japan .

*Primary Examiner*—Lowell A. Larson

*Attorney, Agent, or Firm*—Diller, Ramik & Wight, PC

[57] ABSTRACT

In a die cushion pin pressure equalizing system wherein a plurality of die cushion pins are vertically movably provided in a bolster of a press machine, pressure equalizing hydraulic cylinders supported by die cushions are respectively provided downwardly of the plurality of die cushion pins and the plurality of pressure equalizing hydraulic cylinders are connected to one another through hydraulic paths, so that oil pressure is applied to the pressure equalizing hydraulic cylinders and the hydraulic paths, preload oil pressure acting on the plurality of pressure equalizing cylinders is raised to thereby prevent the plungers from bottoming.

1 Claim, 9 Drawing Sheets

PRELOAD OIL PRESSURE : 25 Kg/cm$^2$

| DIE CUSHIONING ABILITY (PRESET) (ton) | NUMBER OF PIN n | OIL PRESSURE IN PRESSURE EQUALIZING SYSTEM (Kg/cm$^2$) | | ABSORPTION STROKE (MEASURED VALUE) (mm) | |
|---|---|---|---|---|---|
| | | CALCU-LATED PRESSURE | MEASURED PRESSURE | PER DIE CUSHION PIN | TOTAL ABSOPTION |
| 40 | 36 | 52 | 62 | 0.93 | 33 |
| 60 | ↑ | 85 | 82 | 1.43 | 51 |
| 80 | ↑ | 113 | 108 | 2.10 | 76 |
| 100 | ↑ | 142 | 134 | 2.73 | 98 |
| 120 | ↑ | 156 | 155 | 3.24 | 117 |
| 140 | ↑ | 198 | 179 | 3.80 | 137 |
| 160 | ↑ | 226 | 205 | 4.36 | 157 |
| 180 | ↑ | 255 | 228 | 4.73 | 170 |
| 200 | ↑ | 283 | 235 | 4.92 | 177 |
| ↑ | 34 | | 225 | 4.94 | 168 |
| ↑ | 30 | | 238 | 5.00 | 150 |

FIG.4

PRELOAD OIL PRESSURE : 75 Kg/cm$^2$

| DIE CUSHIONING ABILITY (PRESET) (ton) | NUMBER OF PIN n | OIL PRESSURE IN PRESSURE EQUALIZING SYSTEM (Kg/cm$^2$) | | ABSORPTION STROKE (MEASURED VALUE) (mm) | |
|---|---|---|---|---|---|
| | | CALCU-LATED PRESSURE | MEASURED PRESSURE | PER DIE CUSHION PIN | TOTAL ABSOPTION |
| 40 | 36 | | 88 | 0.33 | 12 |
| 60 | ↑ | | 96 | 0.60 | 22 |
| 80 | ↑ | | 115 | 1.11 | 40 |
| 100 | ↑ | | 141 | 1.69 | 61 |
| 120 | ↑ | | 162 | 2.14 | 77 |
| 140 | ↑ | | 185 | 2.73 | 98 |
| 160 | ↑ | | 209 | 3.24 | 117 |
| 180 | ↑ | | 234 | 3.78 | 136 |
| 200 | ↑ | | 256 | 4.32 | 156 |
| ↑ | 34 | | 269 | 4.77 | 162 |
| ↑ | 30 | | 250 | 5.00 | 150 |
| | | | | | |

FIG.5

METHOD OF SELECTING A PRELOAD OIL PRESSURE VALVE FOR A DIE CUSHION PIN PRESSURE EQUALIZING SYSTEM OF A PRESS MACHINE

This application is a continuation of application Ser. No. 08/167,865, filed as PCT/JP92/00775, Jun. 17, 1992, published as WO92/22391, Dec. 23, 1992, now abandoned.

TECHNICAL FIELD

The present invention relates to a method of preventing plungers of pressure equalizing hydraulic cylinders provided in a die cushion pin pressure equalizing system used for press drawing from bottoming.

BACKGROUND ART

To prevent wrinkles from arising over a work piece during a press-drawing operation, a press machine is usually equipped with a die cushion below a lower die half.

FIG. 8 shows the structure of a press machine equipped with a die cushion. In the drawing, reference numeral 1 designates a crown, reference numeral 2 designates an upright, reference numeral 3 designates a bed, a reference numeral 4 designates a slide, reference numeral 5 designates an upper die half, reference numeral 6 designates a lower die half, reference numeral 7 designates a bolster, reference numeral 8 designates a moving bolster, reference numeral 9 designates a die cushion pin or plunger, reference numeral 10 designates a pressure equalizing plate, reference numeral 11 designates a pressure equalizing cylinder, reference numeral 12 designates a die cushion pad, reference numeral 13 designates a die cushion leg, reference numeral 14 designates a die cushion air cylinder, reference numeral 15 designates a die cushion rod, and reference numeral 16 designates a damper filled with hydraulic oil.

As shown in FIG. 8, the bolster 7 is mounted on the bed 3 with the moving bolsters 8 interposed therebetween and the die cushion pad 12 is received in the bed 3. The die cushion pad 12 is supported by the die cushion cylinder 14 mounted on the die cushion leg 13. A compressed air supply source is pneumatically connected to the die cushion cylinders 14 via an air pressure regulating unit (not shown).

The lower die half 6 is mounted on the bolster 7 which is formed with pin holes through which a plurality of die cushion pins 9 are inserted. The die cushion pins 9 serve to support a die pad (not shown) received in the lower die half 6.

A plurality of pressure equalizing hydraulic cylinders 11 are mounted on the plate 10 at positions corresponding to the cushion pins 9. As shown in FIG. 9, the pressure equalizing cylinders 11 are arranged in such a manner that the lower end of die cushion pins 9 come in contact with plungers 18. The flange portion 17 of the plungers 18 is received in a cylinder hydraulic chamber and serves as stoppers for preventing the cylinders 11 from moving upward out of the cylinder hydraulic chambers.

The cylinder hydraulic chambers of the pressure equalizing hydraulic cylinders 11 are hydraulically connected to a hydraulic pressure supply source (not shown) via a hydraulic path 19 such as a drilled hole, a pipe, etc. formed in the plate 10. A check valve is provided at the hydraulic path 19 so as to supply hydraulic oil with a high pressure enough to cancel an error in the length of each die cushion pin into the hydraulic path 19 and the respective cylinder chambers.

In performing a press-drawing operation, die cushion pins 9 are selected corresponding to a die assembly and then the press machine is driven. Since the outflow of the pressurized oil supplied into the respective pressure equalizing hydraulic cylinders 11 is blocked, when the slide 4 and the upper die half 5 are lowered and the selected die cushion pins 9 receive a pressing power, the pressing power is transmitted to the die cushion pad 12 via the die cushion pins 9 and the hydraulic cylinders 11 and is absorbed in the die cushion cylinders 14. At this time, uneven distribution of the pressing power due to the unequal length of die cushion pins 9 as well as assembling error of the parts of the press machine is absorbed in the cushioning pressure of each pressure equalizing cylinder 11.

When a die cushion pin 9 is displaced in excess of a maximum displacement in the die cushion pin pressure equalizing system including a plurality of the hydraulic cylinders 11, there appears a problem that the die cushion pin pressure equalizing system cannot perform a pressure equalizing function. This is because the plunger 18 of the hydraulic cylinder 11 in the die cushion pin pressure equalizing system bottoms on the lower surface of the oil chamber for the hydraulic cylinder 11 as shown in the right-hand part of FIG. 9.

To solve the problem of the bottoming, the following measures have conventionally been taken.

(1) Increasing the number of die cushion pins (2) Reducing air pressure in die cushion cylinders (i.e., die cushion air pressure) to an ultimate extent (3) Reducing the number of continuous strokes (i.e., the number of strokes per one minute, SPM)

However, (1) is difficult to conduct considering the fact that the number of die cushion pins should correspond to a die assembly, (2) is not suited to conduct because defective pressing is likely to occur and (3) is hardly acceptable to manufactures since a production rate per hour becomes reduced.

In the conventional die cushion pin pressure equalizing system, press-drawing operations have been conducted without taking consideration various working conditions such as diameter of the plunger 18 of each pressure equalizing hydraulic cylinder 11, the number of die cushion pins 9 to be used, a pin touch speed, i.e., speed at which the upper die half 5 comes in contact with the die cushion pins 9, total quantity of hydraulic oil filled in the die cushion pin pressure equalizing system and die cushion air pressure. As a result, excessive peak pressure is generated in the pressure equalizing system and crack or breakage by fatigue occurs at the flange portion of the plunger 18 of unused pressure equalizing hydraulic cylinders 11. These problems are considered to occur because an excessively high intensity of peak oil pressure is generated when the die assembly comes in contact with the die cushion pins 9.

In view of the circumstances as mentioned above, it is preferable not to take the measures (1) to (3) and not to change the peak hydraulic pressure.

The present invention has been made in consideration of the aforementioned background and its object is to provide a method of preventing the plungers of the pressure equalizing hydraulic cylinders provided in a die cushion pin pressure equalizing system from the bottoming without the generation of an excessively high peak pressure and without the reduction of productivity and accuracy in press-drawing operations.

DISCLOSURE OF THE INVENTION

In a die cushion pin pressure equalizing system of the present invention wherein a plurality of die cushion pins are vertically movably disposed in the bolster of a press machine, the pressure equalizing hydraulic cylinders are disposed below the die cushion pins while they are supported by a die cushion, and the pressure equalizing hydraulic cylinders are hydraulically connected to each other via an oil path so as to allow an oil pressure to be acted on the pressure equalizing hydraulic cylinders, the plungers of the pressure equalizing hydraulic cylinders are prevented from bottoming by increasing a preload oil pressure exerted on the pressure equalizing hydraulic cylinders.

According to the present invention, since the plungers of the pressure equalizing hydraulic cylinders are prevented from bottoming by simply increasing a preload oil pressure exerted on the pressure equalizing hydraulic cylinders, the bottoming of the plungers can be prevented without generating an excessively high peak oil pressure and without reducing productivity and accuracy of the press-drawing operation.

BRIEF DESCRIPTION OF THE DRAWINGS

FIG. 4 shows a result of the experiments;

FIG. 5 shows another result of the experiments;

BEST MODE FOR CARRYING OUT THE INVENTION

The present invention will now be described in detail with reference to the accompanying drawings which illustrate a preferred embodiment thereof.

Figure 2:
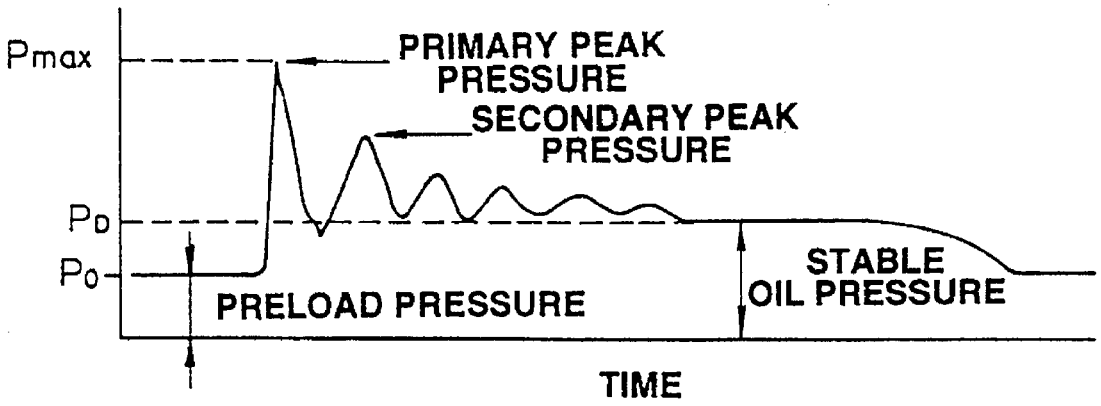
FIG. 2 illustrates the oil pressure in the die cushion pin pressure equalizing system.
Figure 9:
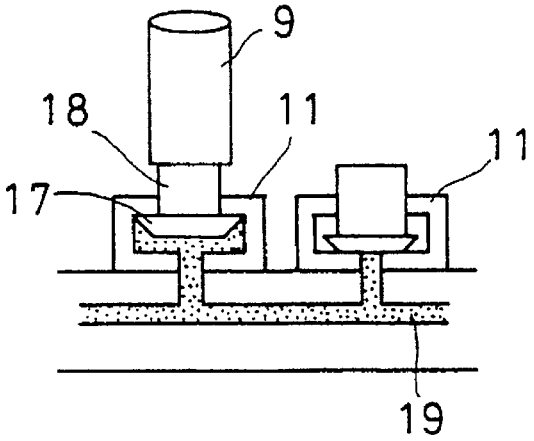
FIG. 9 schematically illustrates the bottoming in the pressure equalizing hydraulic cylinders.
Figure 8:
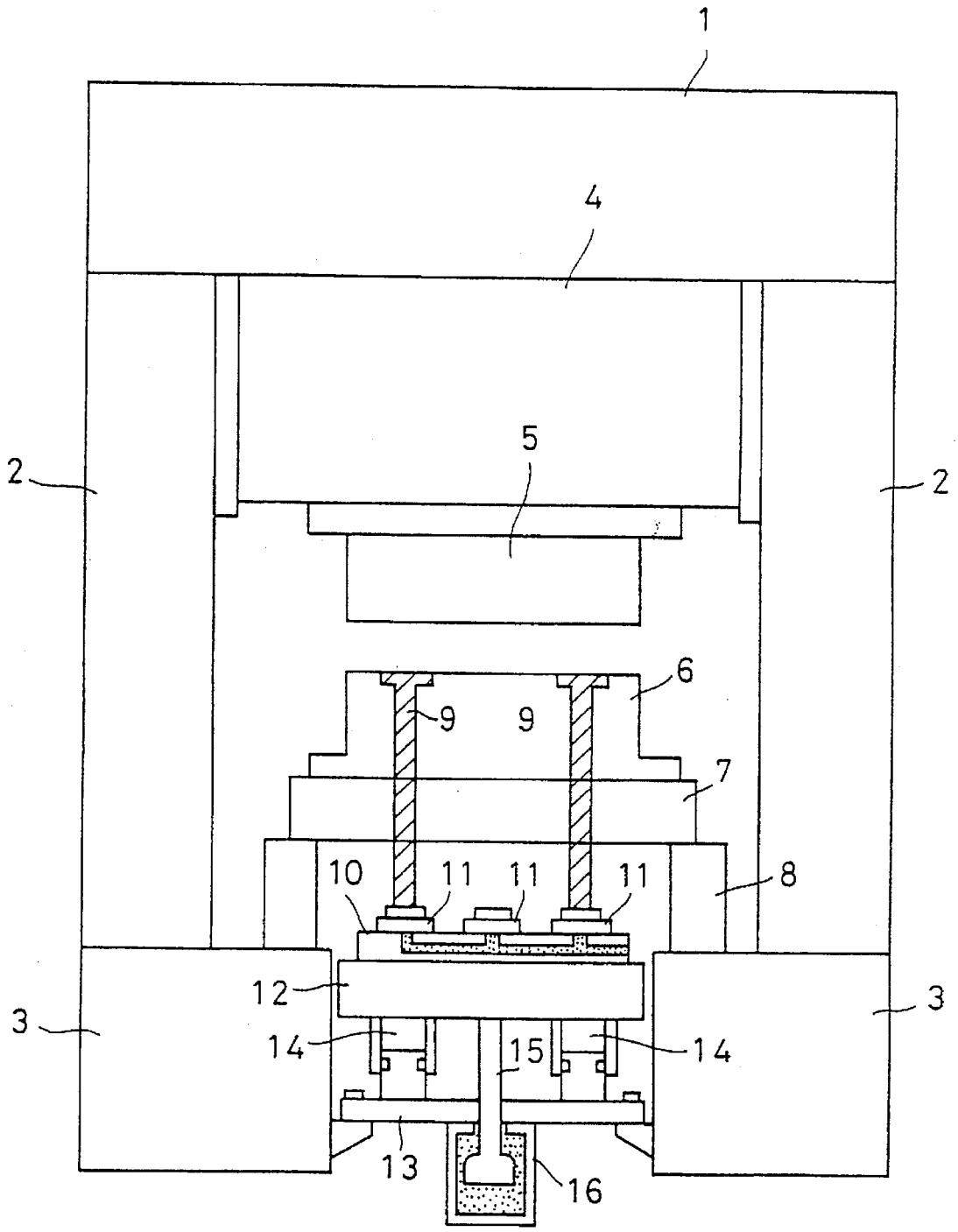
FIG. 8 schematically illustrates a press machine equipped with a die cushion and a die cushion pin pressure equalizing system.

FIG. 2 shows oil pressure in the die cushion pin pressure equalizing system described above with reference to FIG. 8 and FIG. 9 in which reference character PO designates a preload oil pressure, reference character Pmax designates a peak oil pressure (which appears at the time when an upper die half comes in contact with die cushion pins) and reference character PD designates a stable oil pressure. The inventor of the present invention discovered based on results of an experiment that bottoming of the plunger of the pressure equalizing hydraulic cylinder 11 in the die cushion pin pressure equalizing system can reliably be prevented by raising the preload oil pressure PO even when the die cushion pin is displaced in excess of the maximum displacement.

Figure 3:
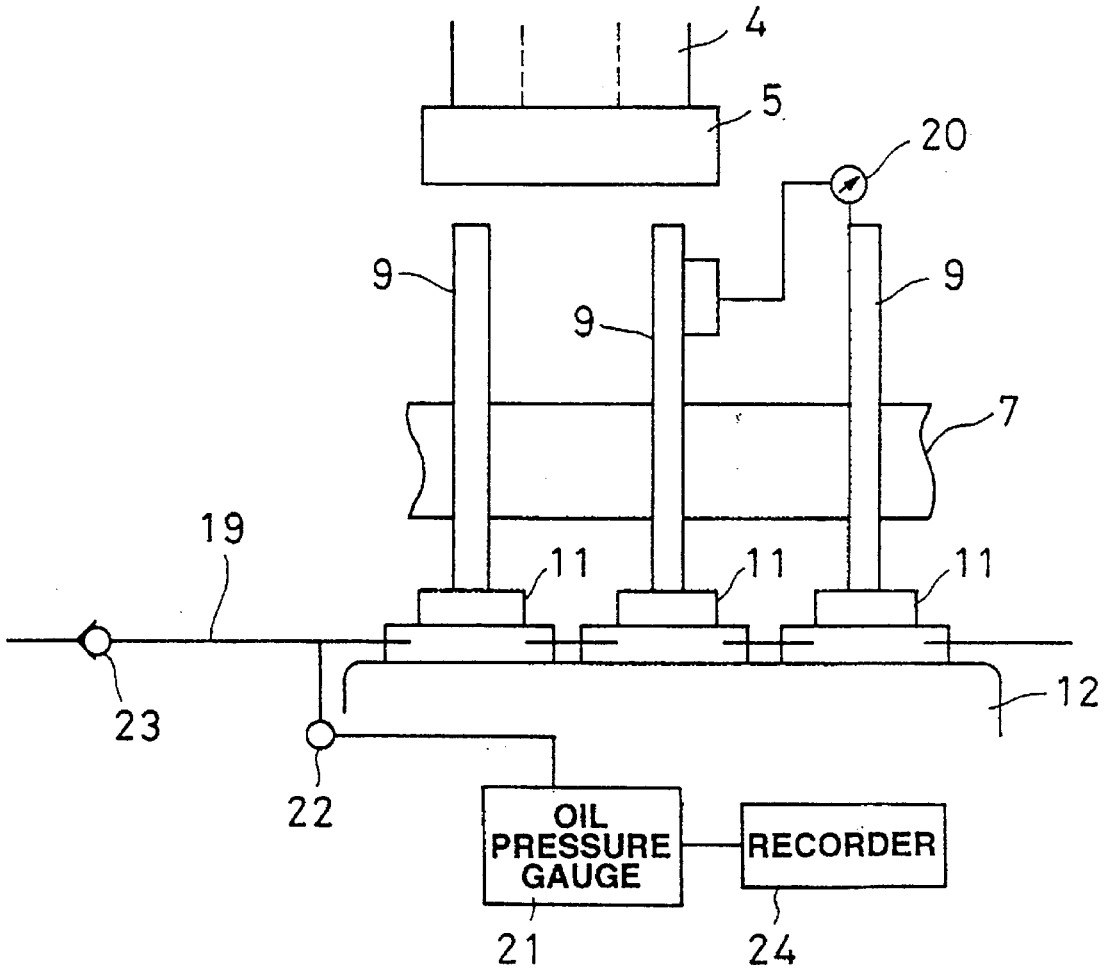
FIG. 3 is a view schematically illustrating the structure of an apparatus used in experiments.

In the experiment, an apparatus as shown in FIG. 3 was prepared. The apparatus includes about 30 to 40 die cushion pins 9 each having a diameter of 60 mm and a length of 675 mm. While driving a slide 4 on which an upper die half 5 is mounted by micro-inching so as to apply pressure to a die cushion, relative stroke between the pressure applied die cushion pin and an unpressured die cushion pin was measured by a dial gauge 20. At this time, an oil pressure appearing in the oil path 19 of the die cushion pin pressure equalizing system was also measured by a pressure meter 21. In FIG. 3, reference numeral 11 designates a pressure equalizing hydraulic cylinder, reference numeral 22 designates a pressure head, reference numeral 23 designates a check valve and reference numeral designates a recorder.

The total absorption stroke 6 is calculated in accordance with the following equation (1).

total absorption stroke $\delta$=(reading of the dial gauge)

*X (the number of pressured die cushion pins)* . . . (1)

Figure 6:
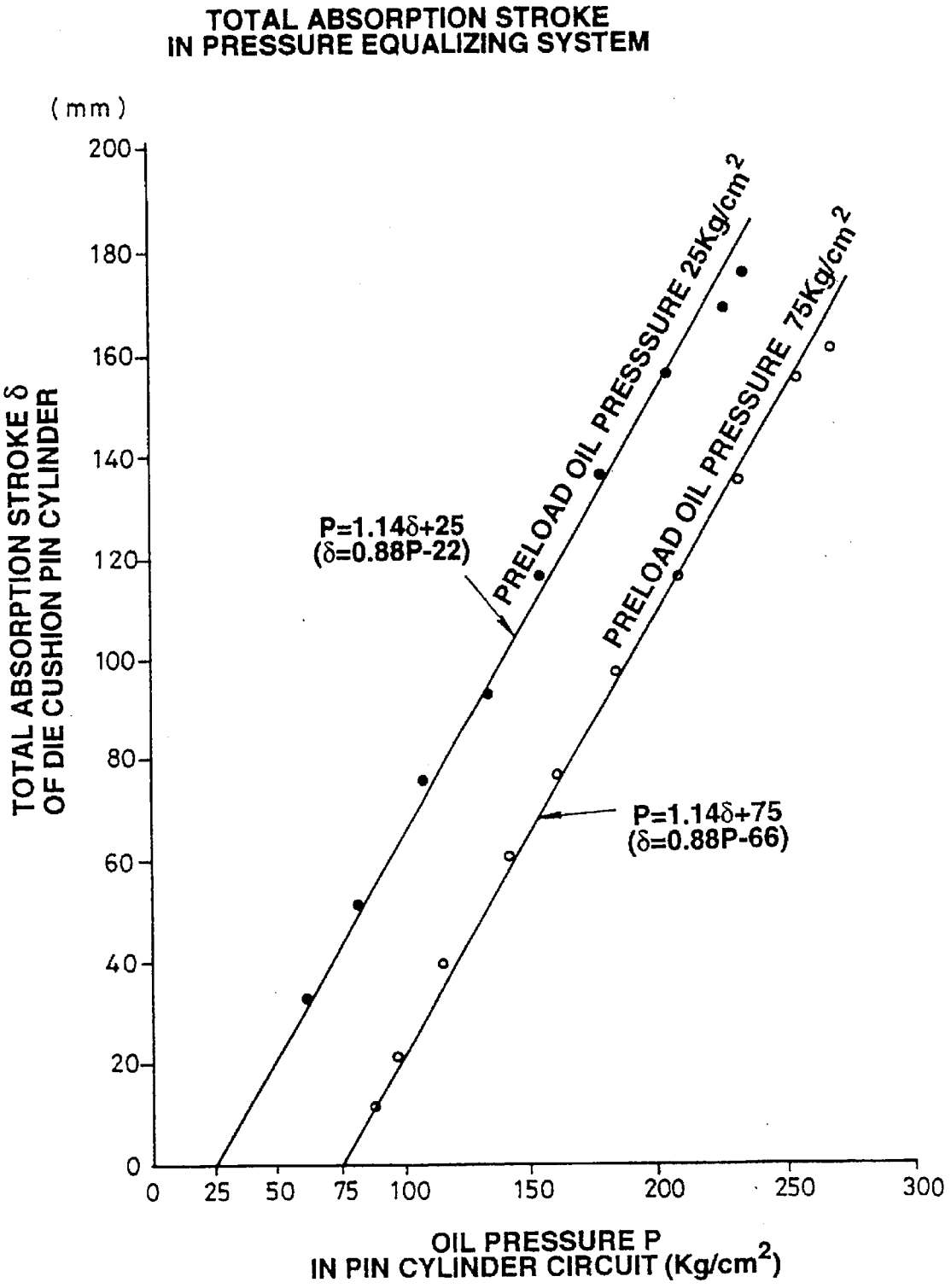
FIG. 6 shows a result of the experiments by a graph illustrating the relationship between total absorption stroke and oil pressure in the die cushion pin pressure equalizing system with two preload pressure as parameters.

FIG. 4 is a table in which die cushion ability, the number of pressured die cushion pins, oil pressure in the die cushion pin pressure equalizing system, and absorption stroke are shown when the preload oil pressure PO is 25 kG/cm$^2$. FIG. 5 shows the above items are shown when the preload oil pressure PO is 75 kG/cm$^2$. FIG. 6 is a graph prepared by plotting the relationship between the total die cushion pin absorption stroke $\delta$ and oil pressure P in the die cushion pin pressure equalizing system when the preload oil pressure PO is 25 kG/cm$^2$ and 75 kG/cm$^2$.

When the plotted points are approximated by a linear line, the relationship of $P=1.14\delta+25$ is obtained when the preload PO is set to 25 kG/cm$^2$ and the relationship represented by an equation of $P=1.14\delta+75$ is obtained when the preload PO is set to 75 kG/cm$^2$.

Figure 1:
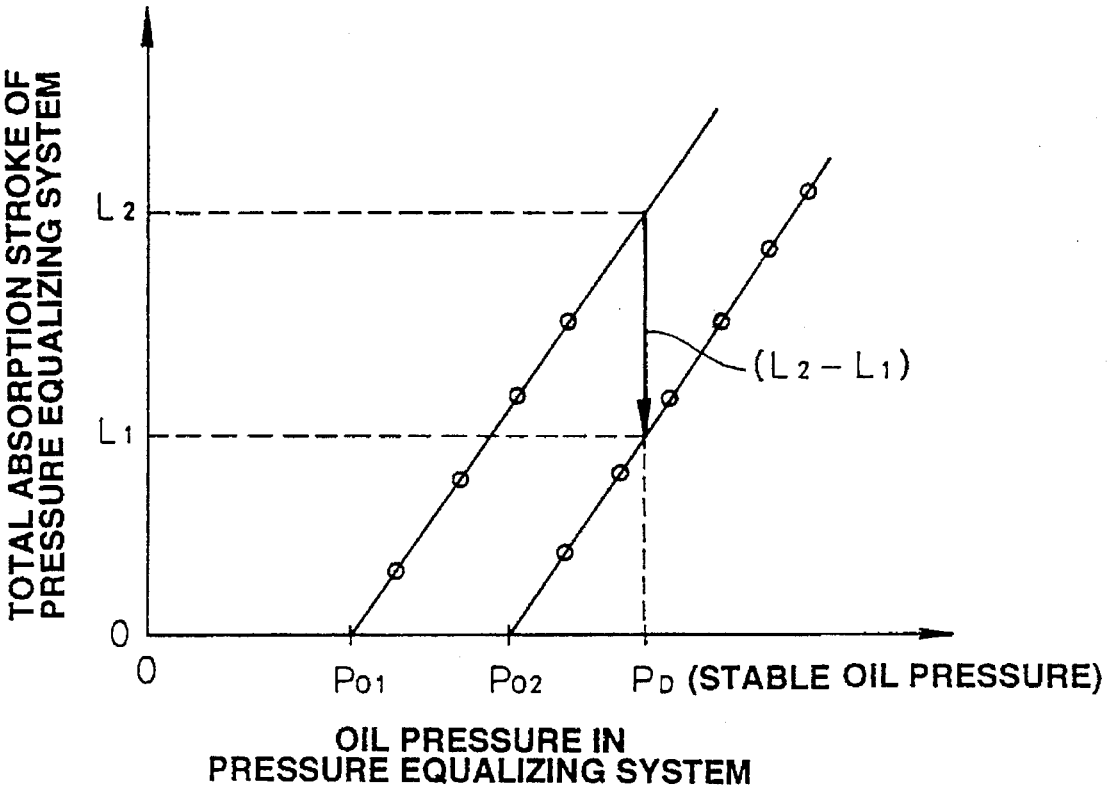
FIG. 1 is a graph illustrating relationship between total absorption stroke and an oil pressure in a die cushion pin pressure equalizing system with two preloads as parameters.

From the Graph shown in FIG. 6, the relationship between the total absorption stroke and the oil pressure in the die cushion pin pressure equalizing system is obtained for the preload oil pressure PO is PO1 and PO2 as shown in FIG. 1. In FIG. 1, reference character PD designates a stable oil pressure value shown in FIG. 2. As is apparent from FIG. 1, when the preload oil pressure is raised from PO1 to PO2, the total absorption stroke at the stable oil pressure PD is shifted from L2 to L1. Thus, the total absorption stroke is shortened by L2–L1. This makes it possible to prevent the bottoming of the plunger of the pressure equalizing hydraulic cylinder 11. In short, according to the present invention, the total absorption stroke of the die cushion pin pressure equalizing system at the stable oil pressure PD is shortened by raising the preload oil pressure by an adequate quantity, whereby the bottoming of the plunger is prevented.

Figure 7:
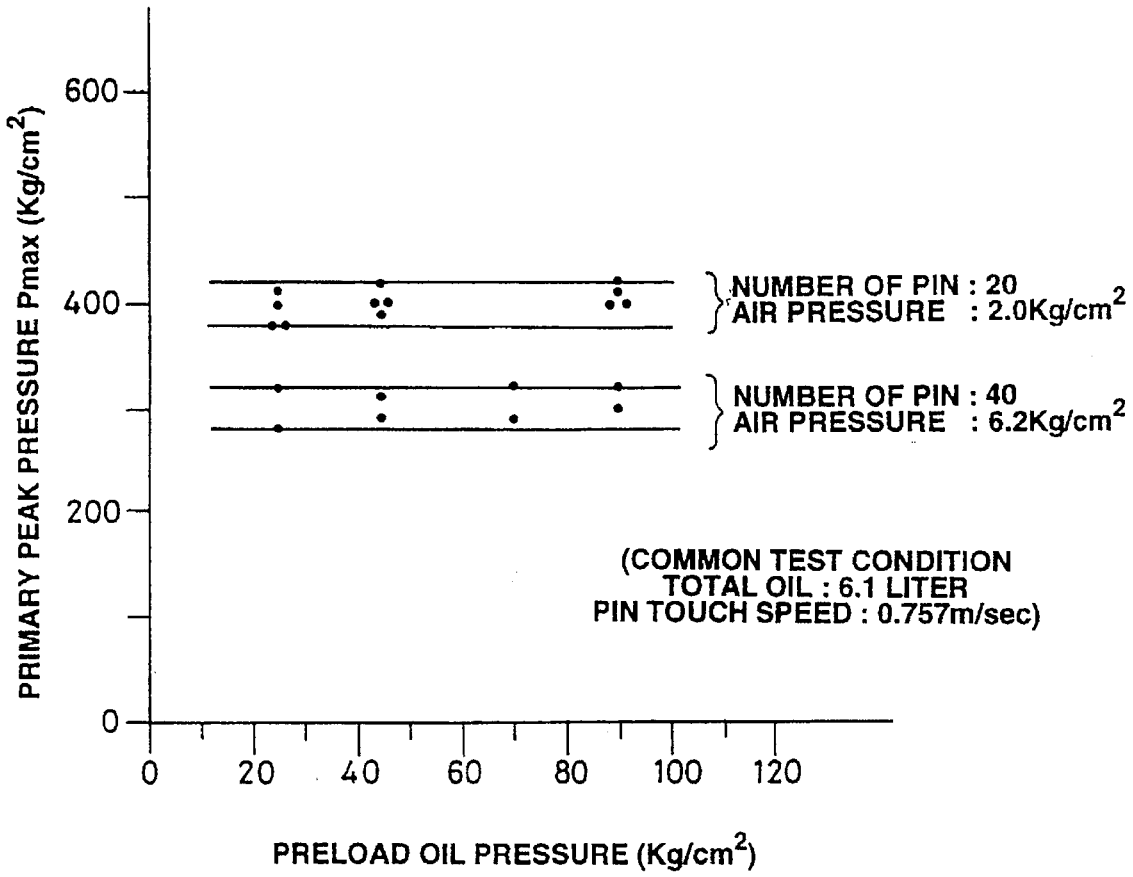
FIG. 7 is a graph illustrating the relationship between primary peak pressure and preload oil pressure.

FIG. 7 shows a result of an experiment and illustrates the relationship between the preload oil pressure PO and the primary peak pressure Pmax for the total quantity of hydraulic oil in the die cushion pin pressure equalizing system of 6 liters and the pin touch speed of 0.757 m/sec under the conditions that the number of used die cushion pins is 20 and the air pressure is 2.0 kg/cm$^2$, and the number of die cushion pins is 40 and the air pressure is 6.2 kg/cm$^2$. In FIG. 7, the primary peak pressure Pmax is plotted substantially in parallel with the abscissa of the graph, which shows that the primary peak pressure Pmax is not affected by the change in the preload pressure.

Since the primary peak pressure does not increase by the increase of the preload oil pressure, the method of the present invention can be practiced without incurring the fatigue crack or breakage at the stopper portion of the plunger in the pressure equalizing hydraulic cylinder 11 which will occur due to the raising of the preload oil pressure as mentioned above.

Figure 10:
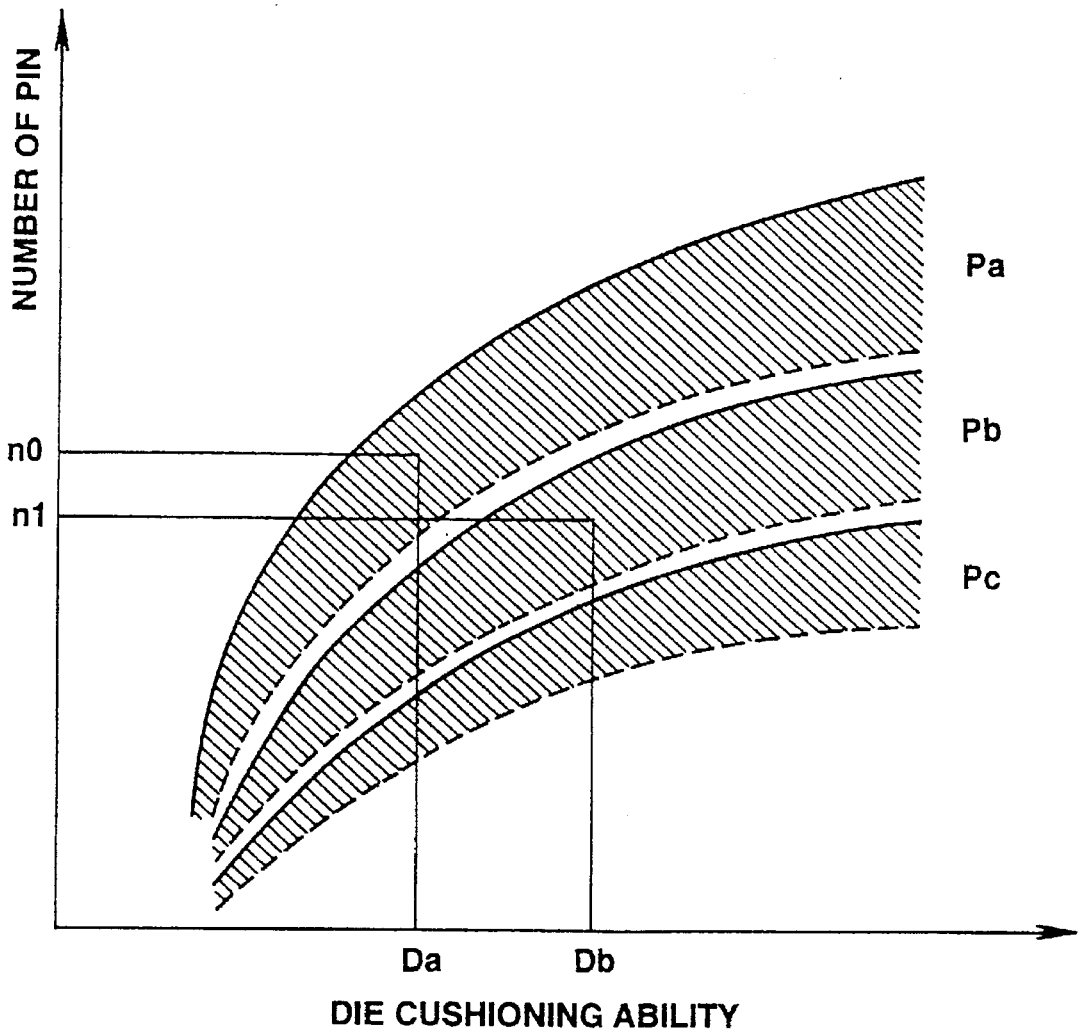
FIG. 10 illustrates die cushion pressure equalizing regions for preload oil pressure Pa, Pb and Pc using die cushioning ability and the number of die cushion pins as parameters.

Referring to FIG. 10, the processes for setting the preload oil pressure PO are now described.

FIG. 10 illustrates die cushion pressure equalizing regions (shadowed portions) for preload oil pressures Pa, Pb and Pc where Pa<Pb<Pc using die cushion load (die cushioning ability) and the number of die cushion pins as variables.

The die cushion pressure equalizing region for each preload oil pressure is defined by a first border line (shown by a solid line) that is formed by plotting the cross points between the number of die cushion pins and the die cushioning ability values, the cross points being border points where the pressure equalizing hydraulic cylinders are transferred from a non-operative state to an operative state when the press machine is operated while the preload oil pressure is acted on the press machine, and a second border line (shown by a dotted line) that is formed by plotting the cross points between the number of die cushion pins and the die cushioning ability values, the cross points being border where the pressure equalizing hydraulic cylinders are transferred from a non-bottoming state to a bottoming state when the press machine is operated while the preload oil pressure is acting on the press machine. When a cross point between the number of die cushion pins and the die cushioning ability value is within the die cushion pressure equalizing region, the above-mentioned bottoming will not occur.

In practice, before operating the press machine, die cushion pressure equalizing regions for a plurality of different preload oil pressures are obtained beforehand by using relations obtained by experimental level or the like, or by performing experiments while taking the number of die cushion pins and die cushioning ability as variables.

In actual operations of the press machine,

For example, in. FIG. 10, suppose that the press machine in which the number of die cushion pins is NO and the die cushioning ability is Da, is operated with the preload oil pressure being Pa. In these conditions, the cross point between the number of die cushion pins and the die cushioning value falls within the die cushion pressure equalizing region, and therefore the bottoming of the plungers of the pressure equalizing hydraulic cylinders will not occur.

Suppose that the die assembly is replaced with another one in the press machine so that the number of used die cushion pins is n1 and the die cushioning ability is Db, and the press machine is operated with the preload oil pressure being Pa. In these conditions, the cross point falls outside of the die cushion pressure equalizing region, therefore the bottoming of the plungers will occur. To prevent the bottoming, the preload oil pressure is raised to, for example, Pb.

INDUSTRIAL APPLICABILITY

The present invention is advantageously employable for press-drawing by using a press machine equipped with a die cushion pin pressure equalizing system. By the present invention, bottoming of the plungers of the hydraulic cylinders arranged in the die cushion pin equalizing system can reliably be prevented.

I claim:

1. A method of selecting a preload oil pressure value for a die cushion pin pressure equalizing system of a press machine comprising a plurality of die cushion pins provided movably in the vertical direction in a bolster of the press machine, and the pressure equalizing hydraulic cylinders each having a plunger which is connected to a lower portion of corresponding ones of the die cushion pins, the plurality of pressure equalizing hydraulic cylinders being supported by die cushions respectively and connected to one another by means of an oil path so as to apply a predetermined preload oil pressure to the pressure equalizing hydraulic cylinders via the oil path, the method comprising:

a first step of setting a die cushion pressure equalizing region for each of a plurality of different preload oil pressures using the number of die cushion pins and a die cushioning ability value as variables, the die cushion pressure equalizing region being defined by a first border line formed by plotting the cross points between the number of die cushion pins and the die cushioning ability values, the cross points being border points where the pressure equalizing hydraulic cylinders are transferred from a non-operative state to an operative state when the press machine is operated while the preload oil pressure is acting on the press machine, and the second border line formed by plotting the cross points between the number of die cushion pins and the die cushioning ability values, the cross points being border points where the pressure equalizing hydraulic cylinders are transferred from a non-bottoming state to a bottoming state when the press machine is operated while the preload oil pressure is acting on the press machine; and a second step of selecting, based on the set conditions, a preload oil pressure value for which the number of the die cushion pin and the die cushioning ability fall within the die cushion pressure equalizing region, and applying the selected preload oil pressure value to the pressure equalizing hydraulic cylinders.

* * * * *